US005328341A

United States Patent [19]

Forni

[11] Patent Number: 5,328,341

[45] Date of Patent: Jul. 12, 1994

[54] SYNCHRONIZER ASSEMBLY FOR A SCROLL FLUID DEVICE

[75] Inventor: Ronald J. Forni, Lexington, Mass.

[73] Assignee: Arthur D. Little, Inc., Cambridge, Mass.

[21] Appl. No.: 95,842

[22] Filed: Jul. 22, 1993

[51] Int. Cl.[5] ..... F01C 1/04; F16D 3/04

[52] U.S. Cl. ..... 418/55.3; 464/102

[58] Field of Search ..... 418/55.3, 188; 464/102, 464/157

[56] References Cited

U.S. PATENT DOCUMENTS

| | | | |
|---|---|---|---|
| 2,475,247 | 7/1949 | Mikulasek | 418/55.3 |
| 3,600,114 | 8/1971 | Dvorak et al. | 418/55.3 |
| 4,911,621 | 3/1990 | McCullough et al. | 418/55.3 |
| 4,927,340 | 5/1990 | McCullough | 418/55.3 |
| 5,051,075 | 9/1991 | Young | 418/55.3 |
| 5,066,206 | 11/1991 | Kakuda et al. | 418/55.3 |
| 5,080,566 | 1/1992 | Sakata et al. | 418/55.3 |

FOREIGN PATENT DOCUMENTS

| | | | |
|---|---|---|---|
| 3-11179 | 1/1991 | Japan | 418/55.3 |

*Primary Examiner*—John J. Vrablik

*Attorney, Agent, or Firm*—Bacon & Thomas

[57] ABSTRACT

A scroll fluid device includes a synchronizer having a plurality of first synchronizer elements, fixedly secured to or integrally formed along a flank portion of one of a pair of meshed wraps, which are interdigited with a plurality of second synchronizer elements carried by a wrap support plate of the other meshed wrap. According to a preferred embodiment of the invention, the synchronizer elements carried by the wrap flank comprise teeth which extend into grooves formed in the support plate of the other wrap. In addition, the synchronizer elements on each of the wraps extend about a predetermined angular portion, preferably 180°, of each of the scroll elements. In this manner, it is possible to form each wrap with both tooth and groove portion,s, each portion extending about complimentary 180° portions of the wrap, which are interdigited with corresponding tooth and groove portions on the other wrap. By forming the synchronizing elements with the flanks and support members of the wraps respectively, the overall dimensions of the scroll fluid device can be significantly reduced, i.e., in the range of 25%. In addition, due to the construction of the synchronizer, fluid can tangentially enter a radially outer inlet zone of the scroll device when the device is used as a compressor, for example. This arrangement further enables delivery of the fluid to the transport chamber(s) formed between the wraps at a reduced velocity in order to increase operating efficiency.

19 Claims, 2 Drawing Sheets

PRIOR ART

SYNCHRONIZER ASSEMBLY FOR A SCROLL FLUID DEVICE

BACKGROUND OF THE INVENTION

1. Field of the Invention

The present invention pertains to the art of scroll fluid devices and, more particularly, to a synchronizer assembly for use in a scroll fluid device.

2. Discussion of the Prior Art

The term "scroll fluid devices" is applied to an arrangement of meshed spiralling wraps that are moved along circular translation paths in orbiting fashion relative to each other when at least one of the wraps is rotated. This orbiting motion produces one or more fluid transport chambers that move radially between inlet and outlet zones of the device. Such scroll devices may function as pumps, compressors, motors or expanders, depending upon their configuration, the drive system utilized and the nature of the energy transferred between the scroll wraps and the fluid moving through the device.

A significant advantage in the operation of a scroll fluid device can be achieved by minimizing its overall size while retaining the same sized transport chambers. Therefore, it is desirable to construct the scroll fluid device as small in diameter as possible. When using a co-rotating scroll arrangement, additional performance advantages are achieved with high speed operation. The power loss due to viscous drag and centrifugal action of the synchronizer teeth is proportional to the speed cubed and the diameter to the fifth power. Doubling the diameter of the teeth alone can result in 32 times the power loss due to windage and centrifugal pumping factors alone. In addition, the noise generated by operation of the device will increase with increased diameter. Reducing the overall diameter of the scroll device by even 25% would be of significant importance.

As is known in the art, scroll wrap pairs typically are coupled by a synchronizer mechanism in order to prevent relative rotation between the wraps while accommodating relative orbital movement therebetween. A typical example of a synchronizer for a scroll fluid device is an Oldham coupling as illustrated in U.S. Pat. No. 4,178,143 to Thelen et al.. Unfortunately, typical Oldham couplings substantially increase both the radial and axial dimensions of the scroll fluid device as well as the amount of friction incurred during operation thereof.

U.S. Pat. No. 4,927,340 to McCullough, illustrated in FIGS. 1 and 2 herein, discloses a synchronizer assembly for use in a scroll fluid device 10 that reduces the axial dimensions of the device at the expense of increasing the radial dimension thereof. The synchronizer comprises a plurality of circumferentially spaced teeth 38, carried by a first wrap support plate 20, which are interdigited with a plurality of circumferentially spaced grooves 40 formed in a second wrap support plate 22. The geometry of this configuration, however, requires that the teeth be placed a significant distance radially outwardly from the scroll wraps 12, 14 in order to ensure that the synchronizer will not interfere with the mated scrolls. Therefore, the diameter of the scroll device must be increased to accommodate this synchronizer arrangement. Other prior art scroll fluid devices having reduced axial dimensions at the expense of their radial dimensions are exemplified by U.S. Pat. Nos. 4,911,621 issued to McCullough et al. and 5,149,255 issued to Young.

Of additional concern, the synchronizer itself can create a problem with respect to the flow of fluid entering the scroll when the scroll device operates as a compressor, for example. The geometry and centrifugal pumping action of the synchronizer teeth in the scroll fluid device disclosed in the '340 Patent and other similar arrangements prevents fluid from entering the transport chamber(s) between the scroll wraps tangentially. Instead, the fluid must pass either radially or axially through the synchronizer. Operation of the scroll device acts to increase the velocity of the fluid as it enters an inlet zone associated therewith. However, the velocity of the fluid must be substantially zero by the time it enters the transport chamber, i.e., by the time the fluid is completely enclosed by the wraps. This requires a rather high velocity fluid stream to be diffused to a low velocity flow, which results is a significant power loss.

Therefore, there exists a need in the art for a synchronizer assembly for preventing relative rotation between meshed wraps of a scroll fluid device, while accommodating relative orbital motion between the wraps, which minimizes the size of the scroll fluid device without diminishing its capacity. In addition, there is a need in the art for a synchronizer device for a scroll fluid device which will permit fluid to enter the device tangentially and at a substantially reduced velocity so as to improve or optimize efficiency of the device.

SUMMARY OF THE INVENTION

The present invention provides a unique synchronizer for use between two meshed wraps of a scroll fluid device which enables the axial and radial dimensions of the device to be minimized while maintaining the capacity of the scroll device. The present invention further provides a unique synchronizer assembly arranged to enable fluids to enter the scroll fluid device tangentially and at a substantially reduced velocity so as to enhance the efficiency of the device.

In order to accomplish these functions, the synchronizer arrangement of the present invention includes a plurality of first synchronizer elements which are fixedly secured to or integrally formed along a flank portion of one of the meshed wraps and a plurality of second synchronizer elements carried by a wrap support plate of the other meshed wrap. The plurality of first and second synchronizer elements are interdigited so as to prevent relative rotation between the wraps while accommodating their relative orbital motion. According to a preferred embodiment of the invention, the synchronizer elements carried by the wrap flank comprise teeth which extend into grooves formed in the support plate of the other wrap. In addition, the synchronizer elements on each of the wraps extend about a predetermined angular portion, preferably 180°, of each of the scroll elements. In this manner, it is possible to form each wrap with both tooth and groove portions, each portion extending about complimentary 180° portions of the wrap, which are interdigited which corresponding tooth and groove portions on the other wrap.

By forming the synchronizing elements with the flanks and support members of the wraps respectively, the overall dimensions of the scroll fluid device can be significantly reduced, i.e., in the range of 25%. In addition, due to the construction of the synchronizer, fluid can tangentially enter a radially outer inlet zone of the scroll device when the device is used as a compressor, for example. This arrangement further enables delivery of the fluid to the transport chamber(s) formed between the wraps at a reduced velocity. Therefore, the synchronizer arrangement of the present invention functions to increase operating efficiency.

DETAILED DESCRIPTION OF THE INVENTION

Figure 1:
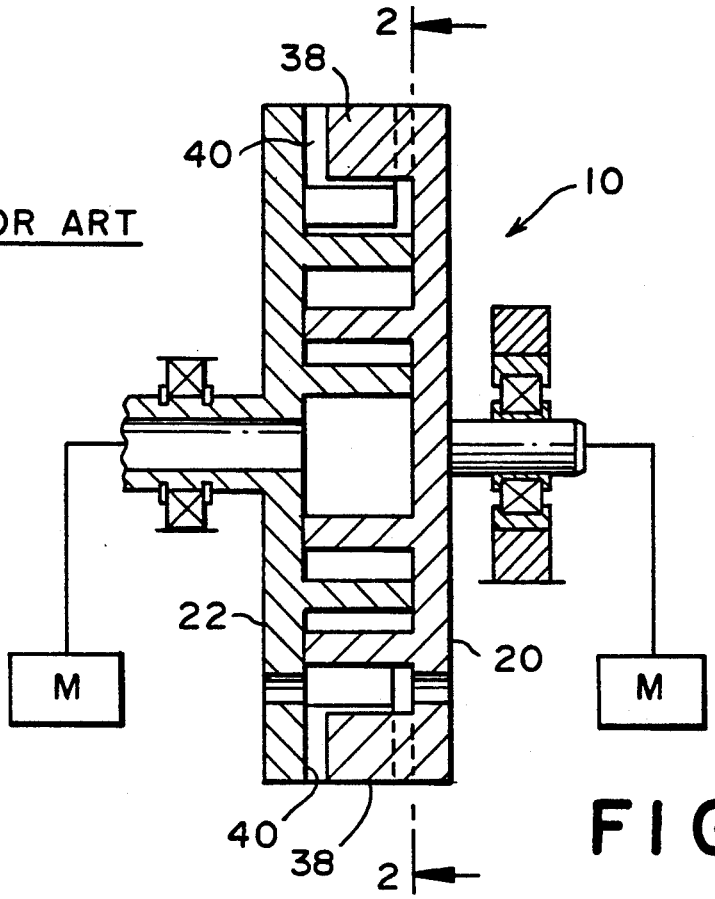
FIG. 1 PRIOR ART
FIG. 1 is a section view taken essentially longitudinally through a co-rotating scroll fluid device according to the prior art.
Figure 2:
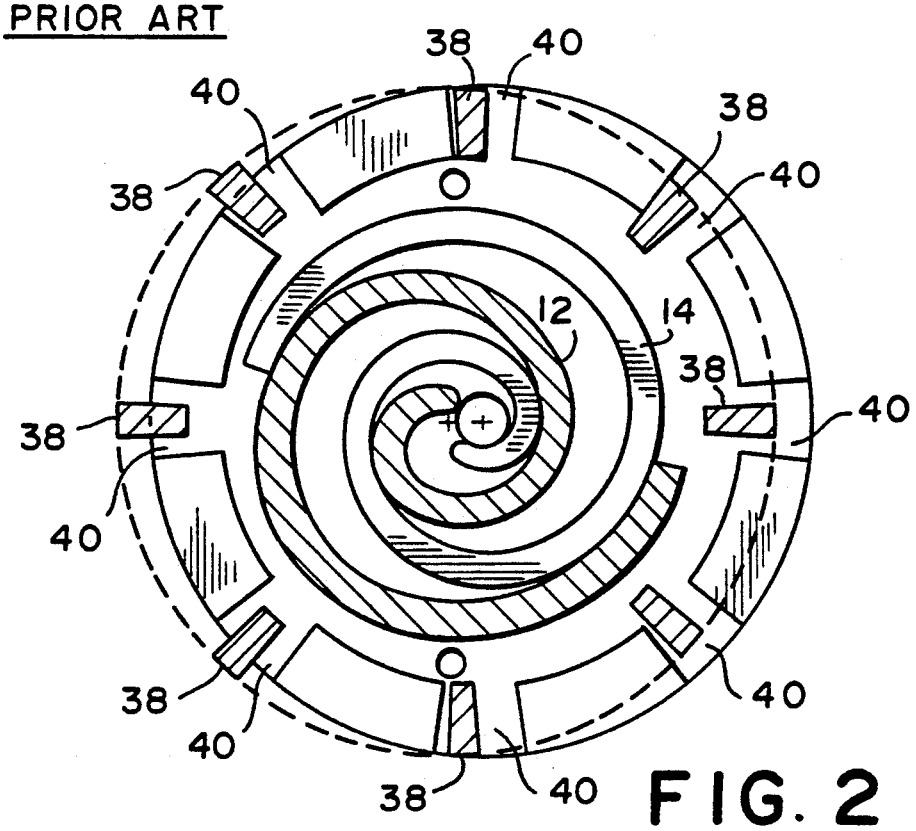
FIG. 2 is a cross-sectional view taken along line 2—2 of FIG. 1.
Figure 3:
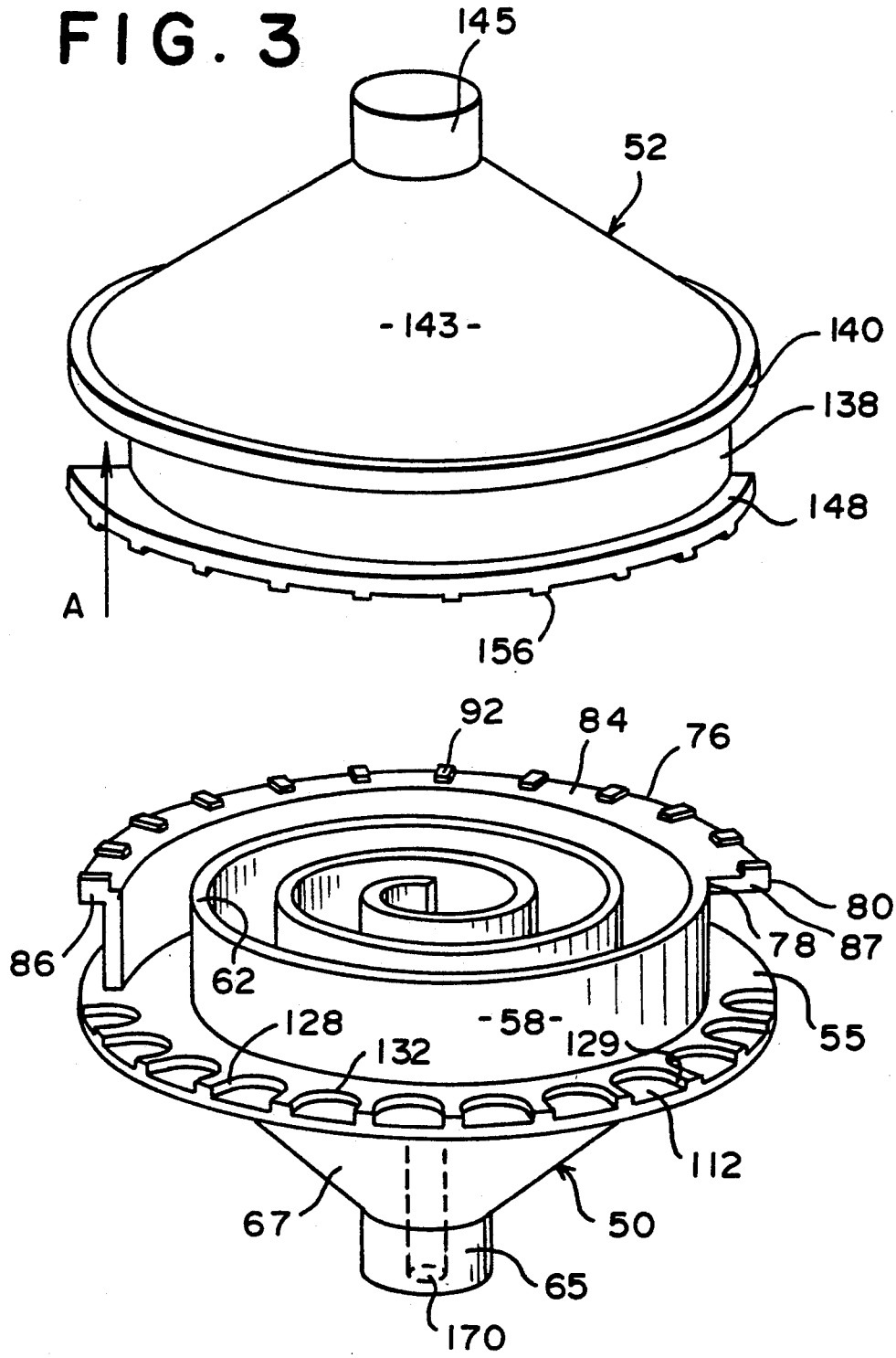
FIG. 3 depicts an exploded perspective view of a scroll fluid device incorporating the synchronizer arrangement according to a preferred embodiment of the present invention.

The synchronizer assembly for use in a scroll fluid device according to the present invention will now be described in detail with reference to FIG. 3. The scroll fluid device includes a first scroll element 50 which is adapted to mesh with a second scroll element 52 as will be more fully discussed below. First scroll element 50 comprises a wrap support plate 55 having mounted thereon a spiral wrap 58. In the preferred embodiment, spiral wrap 58 takes the form of an involute. One end (not labeled) of spiral wrap 58 is fixedly secured to or integrally formed with wrap support plate 55. From this end, spiral wrap 58 extends axially and terminates in a flank portion 62. Although not shown in FIG. 3, the flank portion 62 may be formed with a recess for receiving a tip seal in a manner known in the art. First scroll element 50 further includes a shaft 65 which is attached to wrap support plate 55 by means of a conical support member 67. Although not shown in this figure, first scroll element 50 is adapted to be rotatably supported within a housing by means of bearings in a manner known in the art.

Flank portion 62 of spiral wrap 58 has integrally formed with or fixedly secured thereto a flange 76. In the preferred embodiment, flange 76 is integrally formed with flank portion 62 and extends angularly approximately 180° about flank portion 62. More specifically, flange 76 includes a first inner radial end 78 that is formed integral with flank portion 62 and an outer radial end 80. As shown in FIG. 3, flange 76 defines an upper surface 84 between inner and outer radial ends 78, 80. Flange 76 extends radially outward from flank portion 62 a distance substantially equal to the periphery of wrap support plate 55. More specifically, flange 76 includes a first end 86 and a second end 87. As stated above, first end 86 and second end 87 are spaced approximately 180° apart. Second end 87 extends radially outward from flank portion 62 a distance greater than first end 86 due to the radially inwardly spiraling of spiral wrap 58. The distance which flange 76 extends from flank portion 62 between first and second ends 86, 87 varies along its length. Mounted upon upper surface 84, at predetermined spaced intervals, are a plurality of teeth 92. In the preferred embodiment, teeth 92 extend to outer radial end 80. Teeth 92 further extend from flange 76 axially towards second scroll element 52 as clearly depicted in FIG. 3. Teeth 92 constitute first synchronizer elements in accordance with the present invention.

In the preferred embodiment, first scroll element 50 further carries a plurality of second synchronizer elements in the form of grooves 112. In the embodiment shown, grooves 112 are formed along a portion of the angular periphery of wrap support plate 55. More specifically, grooves 112 extend about approximately 180° of the circumference of wrap support plate 55. This angular portion of wrap support plate 55 is complementary to the angular portion encompassed by flange 76. Each groove 112 comprises a pair of axially extending, opposing sidewalls 128, 129 and an axially extending end wall 132. In the preferred embodiment, grooves 112 open at the outer periphery of wrap support plate 55.

As previously stated, second scroll element 52 is adapted to mesh with first scroll element 50 and the synchronizer assembly of the present invention is adapted to prevent relative rotation between first and second scroll elements 50, 52 while accommodating relative orbital motion therebetween. In a manner directly analogous to the first scroll element 50, second scroll element 52 includes a spiral wrap 138 that axially extends from a wrap support plate 140. Wrap support plate 140 is attached to a conical support member 143 and a shaft 145. As with spiral wrap 58, spiral wrap 138 carries a radially extending flange 148 that extends about a predetermined angular portion of second scroll element 52. As shown in FIG. 3, the extent to which flange portion 148 extends radially outward from spiral wrap 138 varies along the predetermined angular portion. Flange 148 further carries a plurality of teeth 156 in a manner directly analogous to teeth 92. In addition, although not shown in the perspective view of FIG. 3, second scroll element 52 is also provided with a plurality of grooves formed in wrap support plate 140. These grooves are constructed in the same manner as grooves 112 such that first and second scroll elements 50, 52 are substantially identical in construction.

When first scroll element 50 meshes with second scroll element 52, teeth 92 are adapted to extend into the grooves (not shown) formed in wrap support plate 140 and teeth 156 are adapted to extend within respective grooves 112 formed in wrap support plate 55. In this manner, the tooth-in-groove arrangement of the synchronizer according to the present invention functions directly analogous to that disclosed in U.S. Pat. No. 4,927,340, the disclosure of which is hereby incorporated by reference. In general, grooves 112 on wrap support plate 55 and the grooves provided in wrap support plate 140 have a width that accommodates orbital movement of teeth 156 and 92 respectively.

In the preferred embodiment, both first and second scroll elements 50, 52 are mounted for co-rotation together about parallel axes of rotation extending through their respective involute centers. Suitable energy sources such as motors may be used to drive first and second scroll elements 50, 52 by engaging shafts 65 and 145 respectively. The particular mounting arrangement for co-rotating scroll elements 50, 52 has not been shown in the drawings since this is considered to be well known in the art. It should be recognized that upon co-rotation of the scroll elements 50, 52 about their respective axes of rotation, spiral wraps 58 and 138 spin while orbiting relative to each other, wherein the orbital radius is equal to the distance between the involute centers which correspond to the axes of rotation of the scroll wraps and their respective support plates. Typically, the scroll fluid device illustrated in FIG. 3 would operate at high speed.

By integrating the synchronizing elements with the flanks and wrap support members of the wraps respectively, the overall dimensions of the scroll fluid device constructed in accordance with the present invention can be significantly reduced, i.e., in the range of approximately 25% as compared with a scroll fluid device having similar flow capacities known in the prior art. For instance, since the grooves are recessed within their respective wrap support plates, the axial dimension of the scroll fluid device is not increased by the synchronizer assembly. In addition, with flanges 76 and 148 being respectively formed with spiral wraps 58 and 138 while not extending radially outward therefrom a distance greater than wrap support plates 55 and 140, the radial dimension of the scroll fluid device is not increased by the synchronizer assembly of the present invention.

Therefore, as prior known synchronizer assemblies have increased both the axial and/or radial dimensions of the scroll fluid device within which they are incorporated, a scroll fluid device incorporating a synchronizing arrangement of the present invention has the advantage of reduced overall dimensions. In addition, when the scroll fluid device of the present invention is operating as a compressor, fluid is permitted to tangentially enter between the meshed spiral wraps 58 and 138 in the direction of arrow A without being obstructed in its flow by the synchronizer assembly. This fluid can then be compressed radially inwardly and expelled through a suitable outlet such as indicated at 170. Prior art devices supply inlet fluid to the transport chambers between the scroll wraps in either an axial or radial direction. By constructing the synchronizer assembly of the present invention in the manner set forth above, the fluid can be delivered to these transport chambers formed between the wraps at a reduced velocity since the synchronizer assembly enables the inlet fluid to be delivered substantially tangentially, thereby increasing operating efficiency as further outlined above.

Although described with respect to a preferred embodiment of the invention, it should be readily understood that various changes and/or modifications may be made to the synchronizer assembly of the present invention without departing from the spirit thereof. In particular, it is to be noted that, while the invention has been described in connection with co-rotating scroll fluid devices with two drive motors, the synchronizer assembly of the present invention can be used in an orbiting scroll device wherein one of the scroll wraps is driven orbitally relative to an opposed, fixed scroll wrap or a co-rotating system using a single drive motor, with torque transmitted between scroll wraps via the synchronizer. Also, while the present invention has been described with reference to a particular teeth configuration, it should be readily understood that various teeth and groove arrangements could be utilized. In general, the invention is only intended to limited by the scope of the following claims.

I claim:

1. A scroll fluid device comprising:

at least one pair of axially extending spiral wraps each having first and second axially spaced end portions, said wraps being meshed and defining at least one chamber between them that moves radially between an inlet zone and an outlet zone when one wrap is orbited along a circular path about an orbit center relative to the other wrap;

at least one pair of wrap support members, each of said wrap support members being secured to and supporting the first end portion of a respective wrap with the second end portion of each respective wrap defining a scroll flank, at least one of said wrap support members being adapted to be rotated so as to enable relative orbital motion of the wraps relative to each other about an orbit radius; and synchronizer means arranged to prevent relative rotation between said wraps while accommodating their relative orbital motion, said synchronizer means including a plurality of first synchronizer elements associated with the scroll flank of one of said wraps and a plurality of second synchronizer elements associated with the wrap support member of the other of said wraps, said plurality of first synchronizer elements comprising a first set of spaced, axially extending teeth and said plurality of second synchronizer elements comprising a first set of spaced, axially extending grooves, said teeth and grooves being interdigitated.

2. A scroll fluid device as claimed in claim 1, wherein said plurality of first synchronizer elements extend along a predetermined angular portion of the scroll flank of said one wrap.

3. A scroll fluid device as claimed in claim 2, further including flange means extending radially from the scroll flank of said one wrap, said flange means supporting said plurality of first synchronizer elements.

4. A scroll fluid device as claimed in claim 3, wherein the extent to which said flange means extends radially outwardly from the scroll flank of said one wrap varies along the predetermined angular portion of said one wrap.

5. A scroll fluid device as claimed in claim 2, wherein said predetermined angular portion extends approximately 180° from a radially outer end portion of said scroll flank.

6. A scroll fluid device as claimed in claim 5, wherein said plurality of second synchronizer elements extend approximately 180° about the circumference of the wrap support member of said other wrap.

7. A scroll fluid device as claimed in claim 1, further including flange means extending radially from the scroll flank of said one wrap, said flange means having said teeth fixedly secured thereto.

8. A scroll fluid device as claimed in claim 7, wherein the extent to which said flange means extends radially outwardly from the scroll flank of said one wrap varies along the predetermined angular portion of said one wrap.

9. A scroll fluid device as claimed in claim 8, wherein said predetermined angular portion extends approximately 180° from a radially outer end portion of said scroll flank.

10. A scroll fluid device as claimed in claim 9, wherein said grooves extend approximately 180° about the circumference of wrap support member of said other wrap.

11. A scroll fluid device comprising:

at least one pair of axially extending spiral wraps each having first and second axially spaced end portions, said wraps being meshed and defining at least one chamber between them that moves radially between and inlet zone and an outlet zone when one wrap is orbited along a circular path about an orbit center relative to the other wrap:

at least one pair of wrap support members, each of said wrap support members being secured to and supporting the first end portion of a respective wrap with the second end portion of each respective wrap defining a scroll flank, at least one of said wrap support members being adapted to be rotated so as to enable relative orbital motion of the wraps relative to each other about an orbit radius; and synchronizer means arranged to prevent relative rotation between said wraps while accommodating their relative orbital motion, said synchronizer means including a plurality of first synchronizer elements associated with the scroll flank of one of said wraps and a plurality of second synchronizer elements associated with the wrap support member of the other of said wraps, one of said plurality of first and second synchronizer elements comprising a first set of spaced, axially extending teeth and the other of said plurality of first and second synchronizer elements comprising a first set of spaced, axially extending grooves, said teeth and grooves being interdigitated, said synchronizer means further includes a plurality of third synchronizer elements carried by the scroll flank of said other wrap and a plurality of fourth synchronizer elements carried by the wrap support member of said one wrap, one of said plurality of third and fourth synchronizer elements comprising a second set of spaced, axially extending teeth and the other of said plurality of third and fourth synchronizer elements comprising a second set of spaced, axially extending grooves, said second sets of teeth and grooves being interdigitated.

12. A scroll fluid device as claimed in claim 11, wherein said plurality of first and third synchronizer elements comprise said first and second sets of teeth and said plurality of second and third synchronizer elements comprise said first and second sets of grooves, respectively.

13. A scroll fluid device as claimed in claim 12, further including flange means extending radially from the scroll flank of each of said wraps, each of said flange means having fixedly secured thereto a respective one of said first and second sets of teeth.

14. A scroll fluid device as claimed in claim 13, wherein the extent to which said flange means extends radially outwardly from the scroll flank of said one wrap varies along the predetermined angular portion of said one wrap.

15. A scroll fluid device as claimed in claim 14, wherein said predetermined angular portion extends approximately 180° from a radially outer end portion of said scroll flank.

16. A scroll fluid device as claimed in claim 15, wherein said grooves extend approximately 180° about the circumference of wrap support member of said other wrap.

17. A scroll fluid device comprising:

at least one pair of axially extending spiral wraps each having first and second axially spaced end portions, said wraps being meshed and defining at least one chamber between them that moves radially between an inlet zone and an outlet zone when one wrap is orbited along a circular path about an orbit center relative to the other wrap;

at least one pair of wrap support members, each of said wrap support members being secured to and supporting the first end portion of a respective wrap with the second end portion of each respective wrap defining a scroll flank, at least one of said wrap support members being adapted to be rotated so as to enable relative orbital motion of the wraps relative to each other about an orbit radius; and synchronizer means arranged to prevent relative rotation between said wraps while accommodating their relative orbital motion, said synchronizer means including a plurality of first synchronizer elements associated with the scroll flank of one of said wraps and a plurality of second synchronizer elements associated with the wrap support member of the other of said wraps, one of said plurality of first and second synchronizer elements comprising a first set of at least three spaced, axially extending teeth and the other of said plurality of first and second synchronizer elements comprising a first set of at least three spaced, axially extending grooves, each one of said teeth being interdigitated with a respective one of said grooves.

18. A scroll fluid device as claimed in claim 17, wherein each of said grooves has an associated width that enables its associated interdigitated one of said teeth to orbit therein.

19. A scroll fluid device as claimed in claim 18, further comprising flange means extending radially from and along a predetermined angular portion of the scroll flank of said one wrap, said flange means supporting said plurality of first synchronizer elements.

* * * * *